US005956909A

United States Patent [19]

Chou

[11] Patent Number: 5,956,909

[45] Date of Patent: Sep. 28, 1999

[54] WATER DRAINABLE THRESHOLD CONSTRUCTION TO BE LAID UNDER A DOOR

[76] Inventor: Yin-Chu Chou, No. 348, Sec. 1, Chung-Hsing Rd., Hsin-Kang Tsun Shen-Kang Hsiang, Chang-Hua Hsien, Taiwan

[21] Appl. No.: 08/861,971

[22] Filed: May 22, 1997

[51] Int. Cl.[6] ..... E06B 7/14

[52] U.S. Cl. ..... 52/209; 52/211; 52/302.1

[58] Field of Search ..... 52/209, 211, 302.1

[56] References Cited

U.S. PATENT DOCUMENTS

| | | | |
|---|---|---|---|
| 852,450 | 5/1907 | Plym | 52/209 |
| 3,410,027 | 11/1968 | Bates | 52/209 X |
| 3,845,599 | 11/1974 | Jolly | 52/209 |
| 4,691,487 | 9/1987 | Kessler | 52/209 |

*Primary Examiner*—Christopher T. Kent
*Attorney, Agent, or Firm*—Christensen O'Connor Johnson & Kindness PLLC

[57] ABSTRACT

A water drainable threshold construction includes a first extrusion which has a longitudinal outside portion adapted to be placed outwardly of a bottom edge of a door, and a longitudinal inside portion lower than the outside portion. The inside portion has a space adapted for receiving water that flows from the outside portion. A tube extends from the inside portion to an outside portion for draining water from the space to the outside of the outside portion. A second extrusion is longitudinally mounted on the inside portion to cover the space, and has holes for passage of water into the space.

6 Claims, 4 Drawing Sheets

WATER DRAINABLE THRESHOLD CONSTRUCTION TO BE LAID UNDER A DOOR

BACKGROUND OF THE INVENTION

1. Field of the Invention

This invention relates to a threshold to be laid under a door, more particularly to a water drainable threshold.

2. Description of the Related Art

A conventional threshold, which is to be laid under a door, usually forms a clearance with the bottom edge of the door when the door is closed. As such, water on the outside of the door flows into the inside of the door via the clearance, thereby wetting the floor around the door. To solve the aforementioned problem, referring to FIG. 1, a conventional threshold 10 is shown to comprise longitudinal higher outside and lower inside portions 11, 13. An inner wall of the outside portion 11 has a concaved portion 111 adjacent to a top wall 112. A rubber sealing member 12 is received in the concaved portion 111. When closed, the bottom edge of the door 100 can press tightly against the sealing member 12 to block water from entering the inside of the door 100.

Because the sealing member 12 is made of rubber, it is easily deformable after a period of use, thereby resulting in a clearance between the door 100 and the sealing member 12 and in deterioration of the waterproofing effect.

SUMMARY OF THE INVENTION

The main object of the present invention is to provide a threshold with a water drainable construction for draining water outside of a door.

According to this invention, a water drainable threshold construction includes a first extrusion which has a longitudinal outside portion adapted to be placed outwardly of a bottom edge of a door, and a longitudinal inside portion lower than the outside portion. The inside portion has a space adapted for receiving water that flows from the outside portion. A tube extends from the inside portion to the outside portion for draining the water in the space to an outside of the outside portion. A second extrusion is longitudinally mounted on the inside portion to cover the space, and has holes for passage of the water into the space. A better waterproofing effect is thus achieved.

BRIEF DESCRIPTION OF THE DRAWINGS

Other features and advantages of the present invention will become apparent in the following detailed description of preferred embodiments of the invention, with reference to the accompanying drawings, in which.

DETAILED DESCRIPTION OF THE PREFERRED EMBODIMENTS

Figure 1:
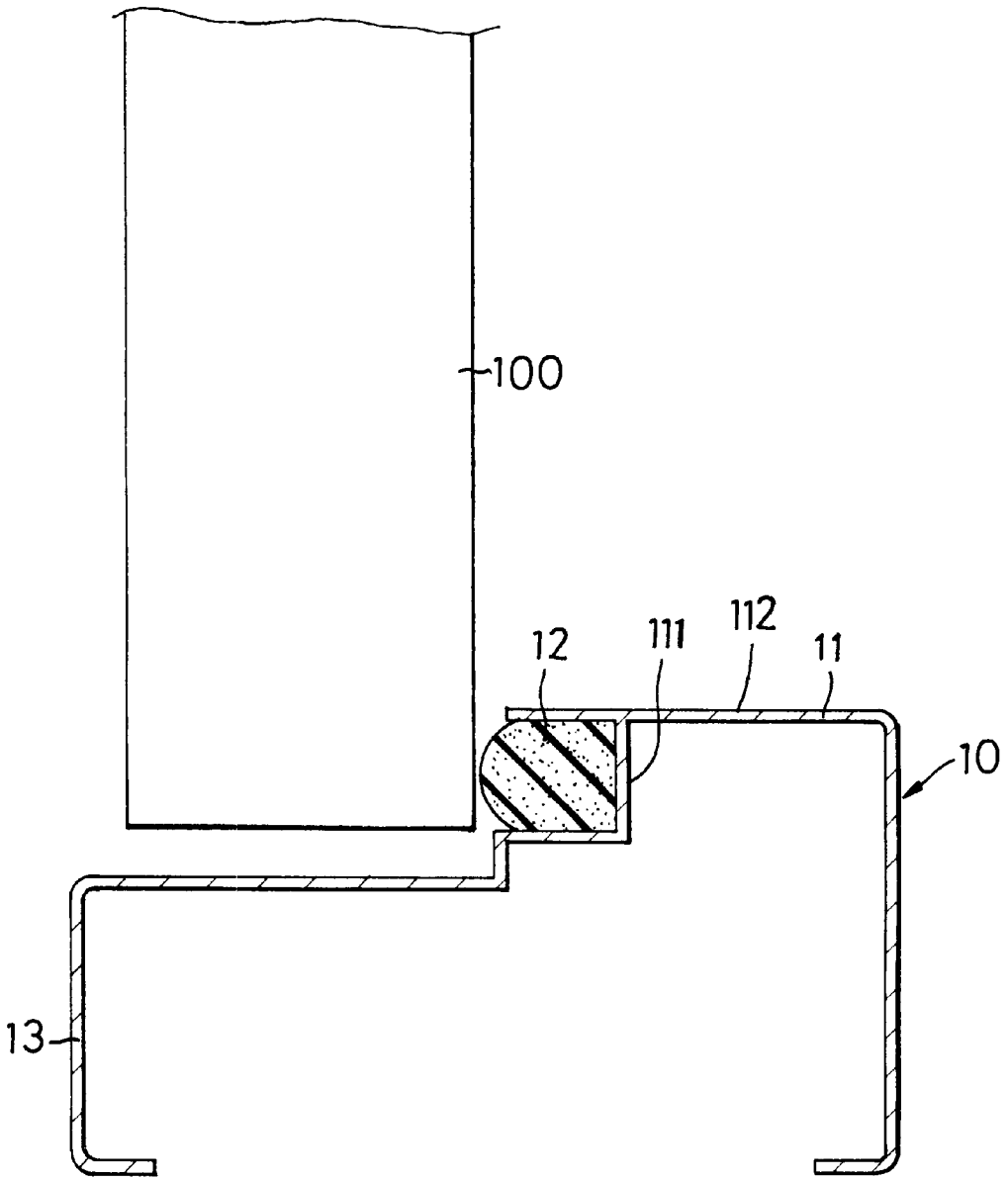
FIG. 1 PRIOR ART
FIG. 1 is a side view of a conventional threshold.
Figure 2:
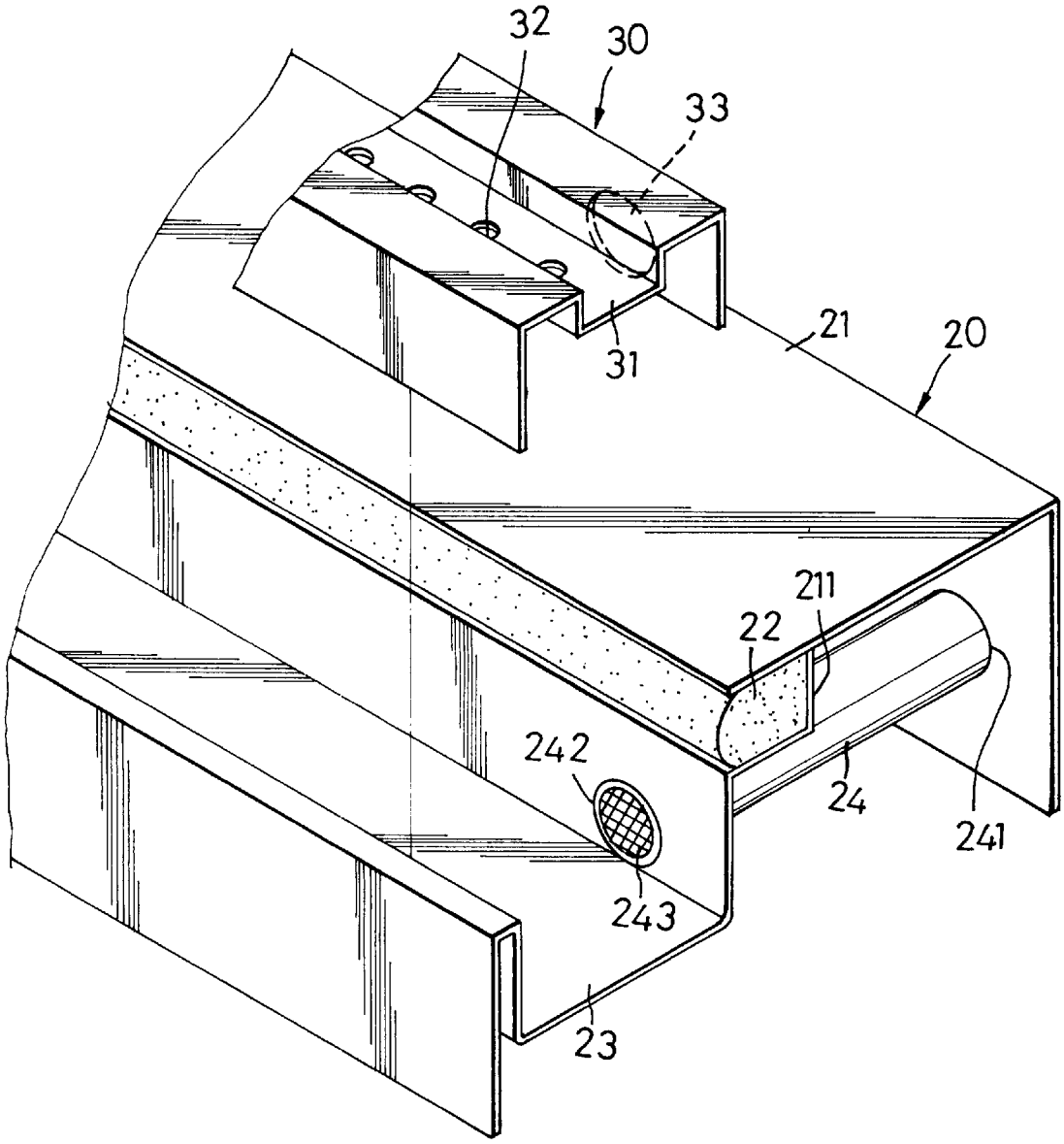
FIG. 2 is an exploded view of a first preferred embodiment of a threshold according to the present invention.
Figure 3:
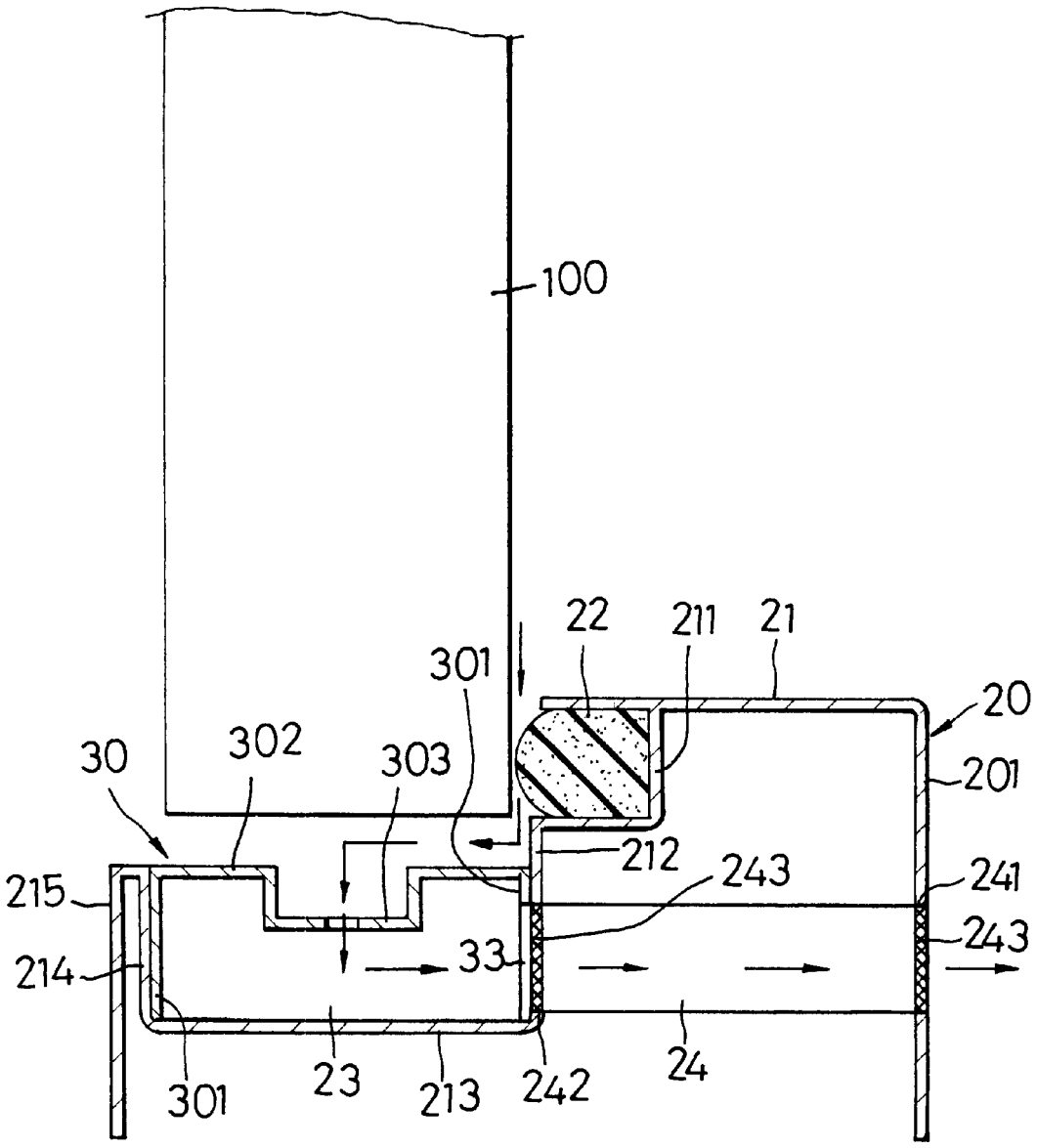
FIG. 3 is a side view of the first preferred embodiment.

Referring to FIGS. 2 and 3, the first preferred embodiment of the threshold according to the present invention is shown to comprise a first extrusion 20 and a second extrusion 30.

The first extrusion 20 has a longitudinal outside portion to be situated outwardly of a bottom end of a door 100 and a longitudinal inside portion adapted to be laid under the door 100. The longitudinal outside portion has an outer wall 201, a top wall 21 which extends inwardly from a top end of the outer wall 201, and a first inner wall 212 which extends downward from the top wall 21. The first inner wall 212 has a concaved portion 211 adjacent to the top wall 21, and a resilient sealing member 22 which is made of a rubber material and which is received in the concaved portion 211. Each of the outer wall 201 and the first inner wall 212 has an opening 243 formed therethrough. A tube 24 extends from a bottom portion of the inner wall 212 to a bottom portion of the outer wall 201, and has two ends 241, 242 in the openings 243. Two net members 243 are mounted in the ends 241, 242 to prevent entry of insects and worms. The longitudinal inside portion is lower than the longitudinal outside portion, and has a bottom wall 213 which extends inwardly from a bottom end of the first inner wall 212, a second inner wall 214 which extends upward from the bottom wall 213, and an innermost wall 215 which extends rearwardly from a top end of the second inner wall 214 and then turns downwardly. The second inner wall 214 and the innermost wall 215 are shorter than the first inner wall 212 and the outer wall 201. The first inner wall 212, the bottom wall 213 and the second inner wall 214 confine a space 23. Preferably, the bottom wall 213 may incline slightly downward from the second inner wall 214 to the first inner wall 212.

The second extrusion 30 is longitudinally disposed between the first and second inner walls 212, 214 above the bottom wall 213 to cover the space 23, and is in the form of a channel which has two legs 301 that are placed in contact with the first and second inner walls 212, 214 and a top panel portion 302 that interconnects upper ends of the legs 301. The top panel portion 302 has an indented part 303 which extends longitudinally therein, and a plurality of holes 32 which are provided in the indented part 303. One of the legs, which abuts against the first inner wall 212, has an outlet 33 for communication with the opening 243 of the first inner wall 212.

In assembly, the longitudinal outside portion is placed in front of a bottom edge of the door 100 while the longitudinal inside portion is placed under the bottom edge of the door 100.

When rain water flows downward from the door 100 and the longitudinal outside portion, a part of the water is blocked from entry into the inside of the door 100 by the sealing member 22. The rest of the water drops into the indented part 303 and is collected in the space 23 via the holes 32. Water in the space 23 is finally drained out from the tube 24 via the outlet 33 and the opening 243 of the first inner wall 212 to the outside of the outer wall 201. As illustrated, in comparison with the conventional threshold, the threshold according to the present invention has a water drainable construction to prevent water from intruding into the inside of the door in addition to the sealing member 22. A better waterproofing effect is therefore achieved.

Figure 4:
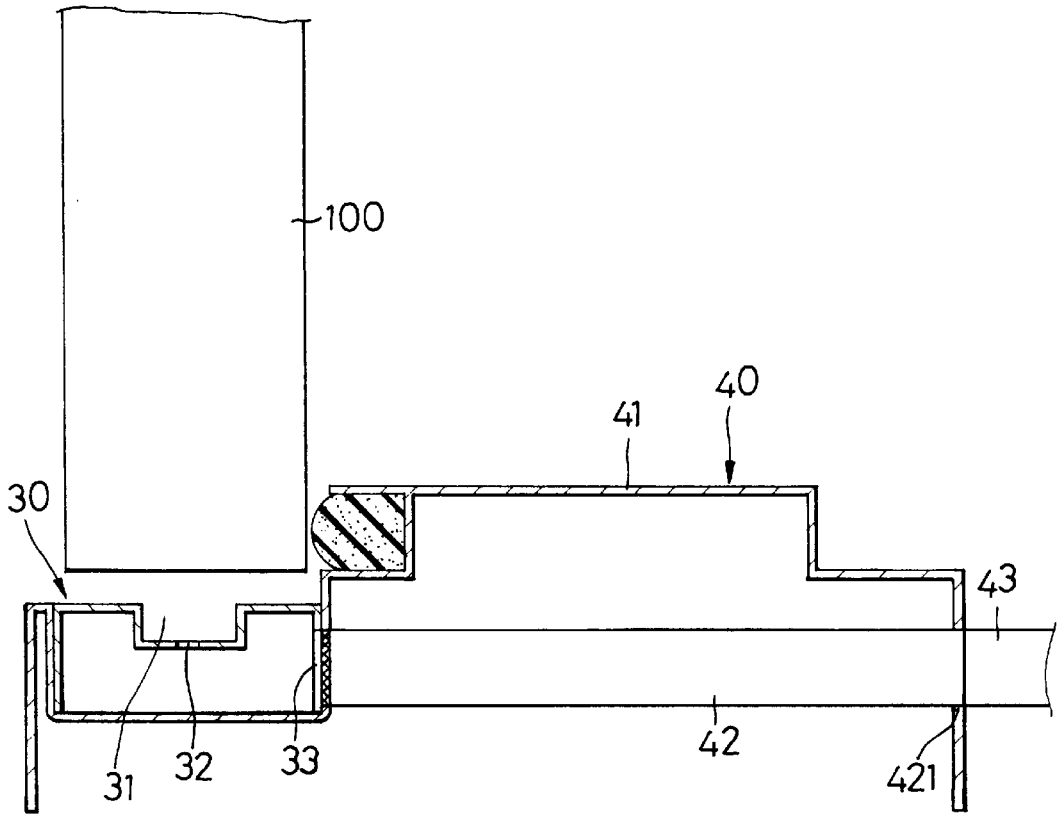
FIG. 4 is a side view of a second preferred embodiment of a threshold according to the present invention.

Referring to FIG. 4, in order to meet the requirement of a different building style, the threshold of the second preferred embodiment includes a top wall 41 which has an increased width and a stepped configuration. A prolonged tube 42 extends through a hole 421 and is connected an external pipe 43 so as to drain water to a predetermined location.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A water drainable threshold construction to be laid under a door, comprising:

a first extrusion having a longitudinal outside portion adapted to be placed outwardly of a bottom edge of the door, said outside portion having an outside, and a longitudinal inside portion lower than said outside portion, said inside portion having a space adapted for receiving water that flows from said outside portion;

means for draining the water in said space through said outside portion to the outside of said outside portion; and a second extrusion longitudinally mounted on said inside portion to cover said space and having holes for passage of the water into said space.

2. A water drainable threshold construction to be laid under a door, comprising:

a first extrusion including an upwardly extending outer wall, a top wall extending inwardly from a top end of said outer wall, a first inner wall extending downward from said top wall, a bottom wall extending inwardly from a bottom end of said first inner wall, a second inner wall extending upward from said bottom wall, and an innermost wall extending rearwardly from a top end of said second inner wall and then turning downwardly, said second inner wall and said innermost wall being shorter than said first inner wall and said outer wall, said first inner wall, said bottom wall and said second inner wall confining a space adapted for receiving water that flows from said top wall;

means for draining the water in said space to an outside of said outer wall; and a second extrusion longitudinally disposed between said first and second inner walls above said bottom wall and having holes for passage of the water into said space.

3. A water drainable threshold construction as claimed in claim 2, wherein said water draining means is a tube which extends from said first inner wall to said outer wall.

4. A water drainable threshold construction as claimed in claim 2, wherein said first inner wall has a concaved portion adjacent to said top wall, and a resilient sealing member received in said concaved portion.

5. A water drainable threshold construction as claimed in claim 2, wherein said second extrusion is formed as a channel which has two legs placed in contact with said first and second inner walls, and a top panel portion interconnecting said legs, said holes being provided in said top panel portion.

6. A water drainable threshold construction as claimed in claim 5, wherein said top panel portion has an indented part extending longitudinally therein, said holes being provided in said indented part.

* * * * *